US008978208B2

(12) United States Patent
Li et al.

(10) Patent No.: US 8,978,208 B2
(45) Date of Patent: Mar. 17, 2015

(54) FOLDING MECHANISM

(71) Applicants: Hong Fu Jin Precision Industry (ShenZhen) Co., Ltd., Shenzhen (CN); Hon Hai Precision Industry Co., Ltd., New Taipei (TW)

(72) Inventors: Jian Li, Shenzhen (CN); Wu-Qi Li, Shenzhen (CN)

(73) Assignee: Zhongshan Innocloud Intellectual Property Services Co., Ltd., Guangdong (CN)

( * ) Notice: Subject to any disclaimer, the term of this patent is extended or adjusted under 35 U.S.C. 154(b) by 0 days.

(21) Appl. No.: 13/724,881

(22) Filed: Dec. 21, 2012

(65) Prior Publication Data

US 2013/0318747 A1 Dec. 5, 2013

(30) Foreign Application Priority Data

May 31, 2012 (CN) ..... 2012 1 0176196

(51) Int. Cl.
*E05D 11/08* (2006.01)
*E05D 3/02* (2006.01)
*E05D 11/10* (2006.01)

(52) U.S. Cl.
CPC ..... *E05D 3/02* (2013.01); *E05D 11/105* (2013.01)
USPC ..... 16/342

(58) Field of Classification Search
CPC ..... E05D 11/06; E05D 11/08; E05D 11/081; E05D 11/082; E05D 11/084; E05Y 2900/602; E05Y 2900/606; G06F 1/1681; G06F 1/1616; G06F 1/1601; G06F 1/1637; H04M 1/0216; H04M 1/0222; H04M 1/0214; H05K 5/0226
USPC ..... 16/342, 340, 337–339, 303, 330, 312, 16/314, 316; 361/679.08, 679.11, 679.12, 361/679.27; 455/575.1, 575.3
See application file for complete search history.

(56) References Cited

U.S. PATENT DOCUMENTS

| | | | | | |
|---|---|---|---|---|---|
| 5,251,949 | A * | 10/1993 | Miller et al. | ..... | 296/97.12 |
| 6,035,491 | A * | 3/2000 | Hartigan et al. | ..... | 16/342 |
| 6,230,365 | B1 * | 5/2001 | Lu | ..... | 16/342 |
| 2007/0000088 | A1 * | 1/2007 | Mao et al. | ..... | 16/54 |
| 2010/0037431 | A1 * | 2/2010 | Chiang | ..... | 16/342 |
| 2010/0064475 | A1 * | 3/2010 | Wang et al. | ..... | 16/232 |
| 2010/0139042 | A1 * | 6/2010 | Chang | ..... | 16/297 |
| 2011/0047748 | A1 * | 3/2011 | Chien | ..... | 16/250 |
| 2011/0061195 | A1 * | 3/2011 | Ikunami | ..... | 16/250 |
| 2011/0154614 | A1 * | 6/2011 | Chien | ..... | 16/342 |
| 2013/0111705 | A1 * | 5/2013 | Mai et al. | ..... | 16/342 |

* cited by examiner

*Primary Examiner* — Chuck Mah
(74) *Attorney, Agent, or Firm* — Novak Druce Connolly Bove + Quigg LLP

(57) ABSTRACT

A folding mechanism includes a first main body, a second main body, and a hinge assembly fixed between the first main body and the second main body. The hinge assembly includes a sleeve member and a fixing shaft. The sleeve member includes a fixing portion and a sleeve portion. The fixing portion is mounted on the first main body. The sleeve portion extends from an end of the fixing portion adjacent to the second main body. The fixing shaft is inserted into the sleeve portion, and is mounted to the second main body. At least one elastic strip protrudes from the fixing portion towards the sleeve portion. At least one ridge protrudes from the fixing shaft corresponding to the at least one elastic strip. The at least one elastic strip abuts against the fixing shaft.

13 Claims, 5 Drawing Sheets

FOLDING MECHANISM

BACKGROUND

1. Technical Field

The present disclosure relates to folding mechanisms, particularly to a folding mechanism configured with a hinge assembly, for opening or closing two main bodies.

2. Description of Related Art

A commonly used electronic device, such as notebook, includes a liquid crystal display and a hinge mechanism. The electronic device opens and closes via the hinge mechanism to enable the liquid crystal display to be viewed from many angles, thus the electronic device obtains a higher degree of maneuverability and convenience.

However, such a hinge mechanism as used in the electronic device is made of metallic material and includes a fixing member, a first pivotal assembly and a second pivotal assembly. The first and second pivotal assemblies generally include many components, thus the hinge mechanism becomes complicated, and is unable to satisfy the demand for lightness and thinness. In addition, the hinge mechanism receives great amount of friction during the opening or closing of the electronic device, which results in a shorter working lifespan of the hinge mechanism.

Therefore, there is room for improvement in the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Figure 1:
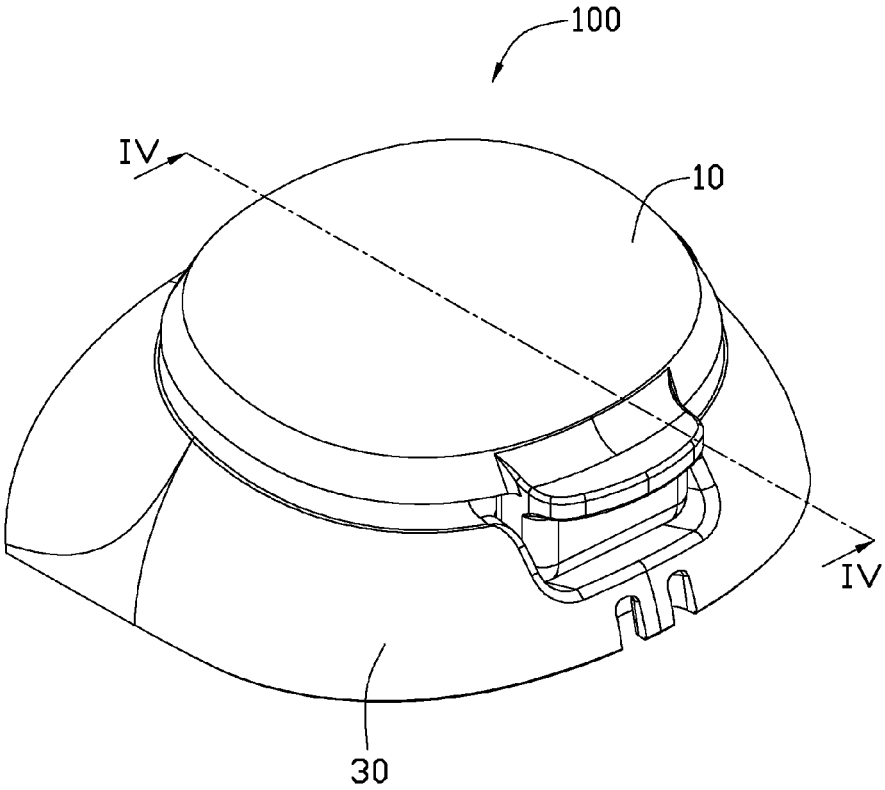
FIG. 1 is an isometric view of an embodiment of a folding mechanism, the folding mechanism including a first main body.
Figure 2:
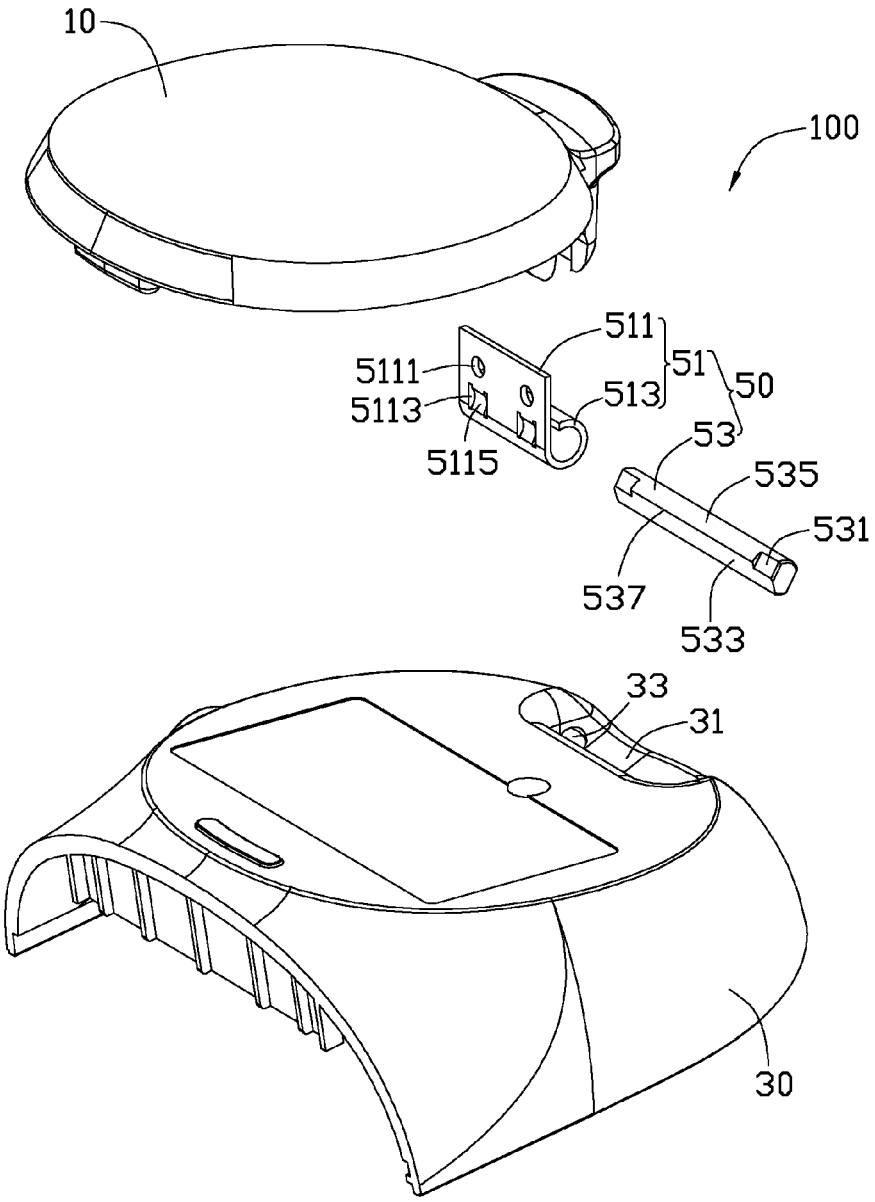
FIG. 2 is an exploded, isometric view of the folding mechanism shown in FIG. 1.

FIGS. 1 and 2 show a folding mechanism 100 of one embodiment. The folding mechanism 100 includes a first main body 10, a second main body 30, and a hinge assembly 50 connecting the first main body 10 and the second main body 30. The first main body 10 is capable of opening or closing relative to the second main body 30 via the hinge mechanism 50.

Figure 3:
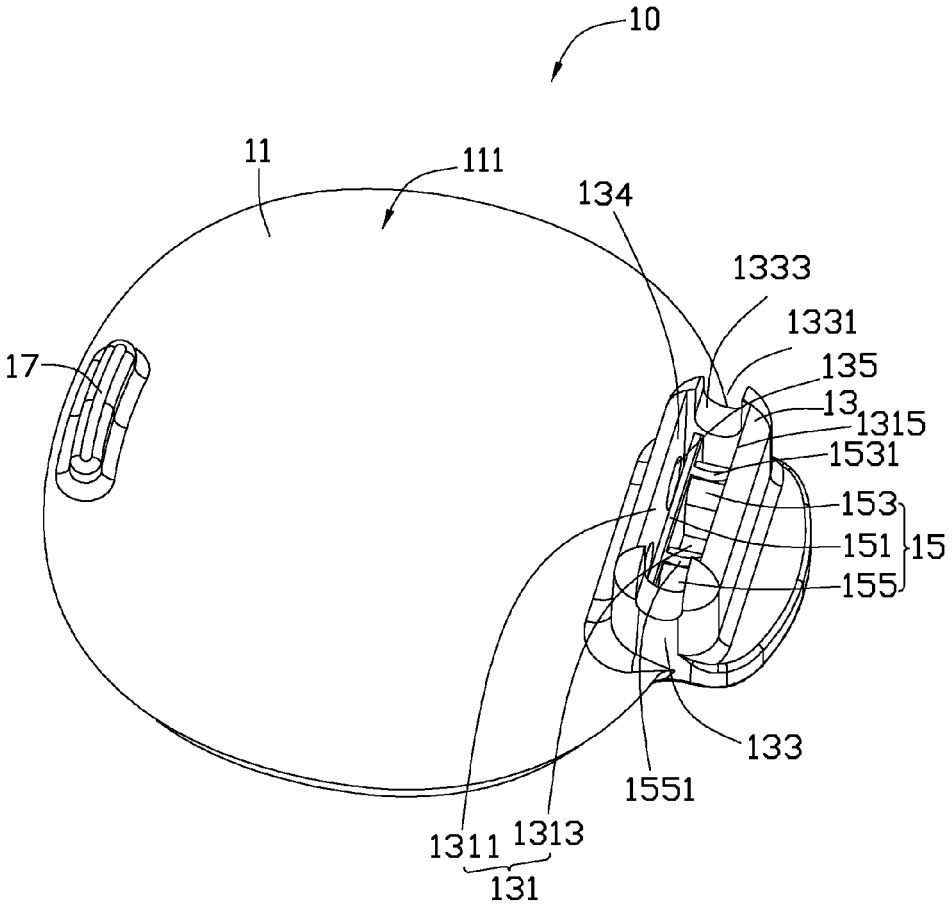
FIG. 3 is an enlarged, isometric view of the first main body of the folding mechanism shown in FIG. 1.

FIG. 3 shows the first main body 10 of the embodiment. The first main body 10 includes a base body 11, a mounting member 13, a resisting member 15, and an engaging member 17. The base body 11 includes a mounting surface 111 adjacent to the second main body 30 and is substantially a disk-shaped. The mounting member 13 protrudes outwardly from an end of the mounting surface 111 of the base body 11, for receiving the hinge assembly 50. The engaging member 17 protrudes outwardly from another end of the mounting surface 111 opposite to the mounting member 13, for resisting the second main body 30 when the first main body 10 is closed relative to the second main body 30. The resisting member 15 is mounted in the mounting member 13, for resisting the hinge assembly 50.

The mounting member 13 is substantially a bar-shaped protrusion, and defines a receiving groove 131 along a longitudinal direction thereof. The mounting member 13 includes a pair of blocking sidewalls 133 located at opposite ends of the receiving groove 131 along a longitudinal direction. Each blocking sidewall 133 defines a containing groove 1331, and the containing grooves 1331 communicate with the receiving groove 131. A bottom surface 1333 of each containing groove 1331 is an arcuate surface. An inner sidewall 134 of the receiving groove 131 adjacent to the engaging member 17 defines a pair of mounting holes 135, for assembling the hinge assembly 50. The mounting holes 135 communicate with the receiving groove 131.

The resisting member 15 is integrated within the receiving groove 131, and includes a blocking plate 151, a first resisting portion 153, and a second resisting portion 155. The blocking plate 151 is positioned along the longitudinal direction of the receiving groove 131, and separates the receiving groove 131 into a first receiving groove 1311 and a second receiving groove 1313. A width of the first receiving groove 1311 is narrower than that of the second receiving groove 1313. The first resisting portion 153 and the second resisting portion 155 substantially perpendicularly interconnect the blocking plate 151 and an inner sidewall 1315 of the second receiving groove 1313 parallel to the inner sidewall 134 of the receiving groove 131, respectively. The first resisting portion 153 and the second resisting portion 155 are received in the second receiving groove 1313, and are respectively aligned with the pair of mounting holes 135. The blocking plate 151 defines a pair of engaging holes (not shown) corresponding to the pair of mounting holes 135, and the engaging holes respectively pass through the first resisting portion 153 and the second resisting portion 155. A top of the first resisting portion 153 comprises a first contacting surface 1531, and a top of the second resisting portion 155 comprises a second contacting surface 1551. The first contacting surface 1531 and the second contacting surface 1551 are arcuate surfaces. The first contacting surface 1531 and the second contacting surface 1551 are lower than the bottom surface 1333 of the containing groove 1331.

FIG. 2 further shows that the second main body 30 defines a mounting groove 31 at a side surface thereof adjacent to the first main body 10, for receiving the mounting member 13 and the resisting member 15. Each of opposite ends of the mounting groove 31 defines a fixing groove 33 communicating with the mounting groove 31, for fixing the hinge assembly 50.

The hinge assembly 50 includes a sleeve member 51 and a fixing shaft 53 inserted through the sleeve member 51. The sleeve member 51 is mounted on the first main body 10. The fixing shaft 53 is attached with the second main body 30. When the sleeve member 51 rotates relative to the fixing shaft 53, the first main body 10 opens or closes relative to the second main body 30.

The sleeve member 51 includes a fixing portion 511 and a sleeve portion 513 extending from an end of the fixing portion 511. The fixing portion 511 is substantially sheet-shaped, and is positioned in the first receiving groove 1311 of the mounting member 13. Two elastic strips 5115 protrude from the fixing portion 511 towards the sleeve portion 513, and are configured to abut against the fixing shaft 53. The elastic stripes 5115 are substantially arc-shaped. The fixing portion 511 defines two holes 5111 located at a side of corresponding elastic strips 5115 away from the sleeve portion 513, respectively. Two openings 5113 are defined at the fixing portion 511 corresponding with each of the two elastic strips 5115, respectively. Each elastic strip 5115 extends from an inner surface of the opening 5113 towards the sleeve portion 513. The sleeve portion 513 is configured to be received in the second receiving groove 1313, and an outer cylindrical sidewall of the sleeve portion 513 resists the first contacting surface 1531 and the second contacting surface 1551. In other embodiments, the number of the hole 5111 can be one, three, four or more. A number of the opening 5113 or the elastic strip 5115 can be one, three, four, or more, correspondingly.

The fixing shaft 53 is inserted into the sleeve portion 513, and two ends of the fixing shaft 53 are mounted on the fixing grooves 33 defined in the second main body 30. Each end of the fixing shaft 53 defines a cutting surface 531, thus the sectional surfaces on the ends of the fixing shaft 53 are not circular, which results in the fixing shaft 53 not being rotatable relative to the second main body 30. The fixing shaft 53 is shaped as a rod being cut along a longitudinal direction thereof, thus an outer sidewall of the fixing shaft 53 includes a planar surface 533 extending along an axis of the fixing shaft 53 and an arcuate surface 535 connecting with the planar surface 533 extending along the axis of the fixing shaft 53. The arcuate surface 535 resists on the bottom surface 1333 of the containing groove 1331. A ridge 537 is formed at a connecting edge portion between the planar surface 533 and the arcuate surface 535.

In assembly, the fixing shaft 53 is inserted into the sleeve portion 513, and the planar surface 533 of the fixing shaft 53 resists to the elastic strip 5115. Two ends of the fixing shaft 53 are fixed within the fixing grooves 33 of the second main body 30. The fixing portion 511 of the sleeve member 51 is received in the first receiving groove 1311 of the first main body 10, and the holes 5111 are respectively aligned with the corresponding mounting holes 135 and corresponding engaging holes. The fixing portion 511 is positioned with the mounting member 13 via using fasteners (not shown) inserting into the mounting holes 135, the holes 5111, and the engaging holes; and the sleeve portion 513 is received in the second receiving groove 1313. Therefore, the mounting member 13 and the resisting member 15 are contained in the mounting groove 31 of the second main body 30. The first main body 10 closes relative to the second main body 30, and the engaging member 17 abuts against the second main body 30.

Figure 4:
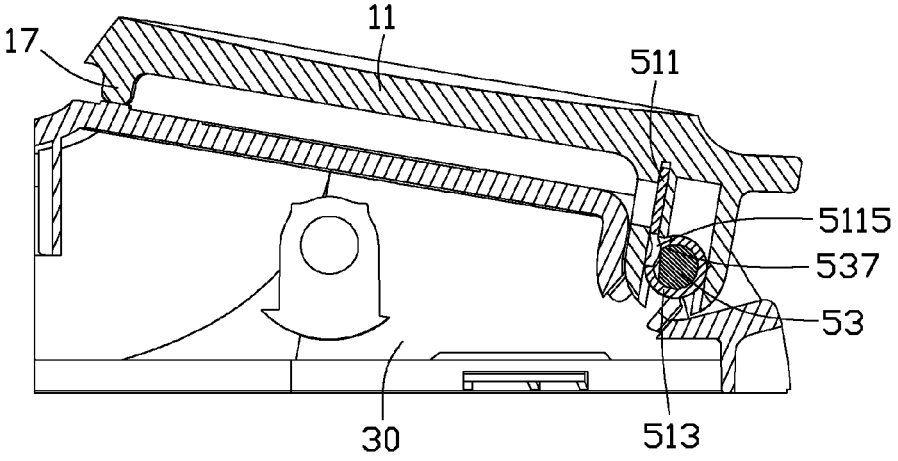
FIG. 4 is sectional view of the folding mechanism taken along line IV-IV shown in FIG. 1.
Figure 5:
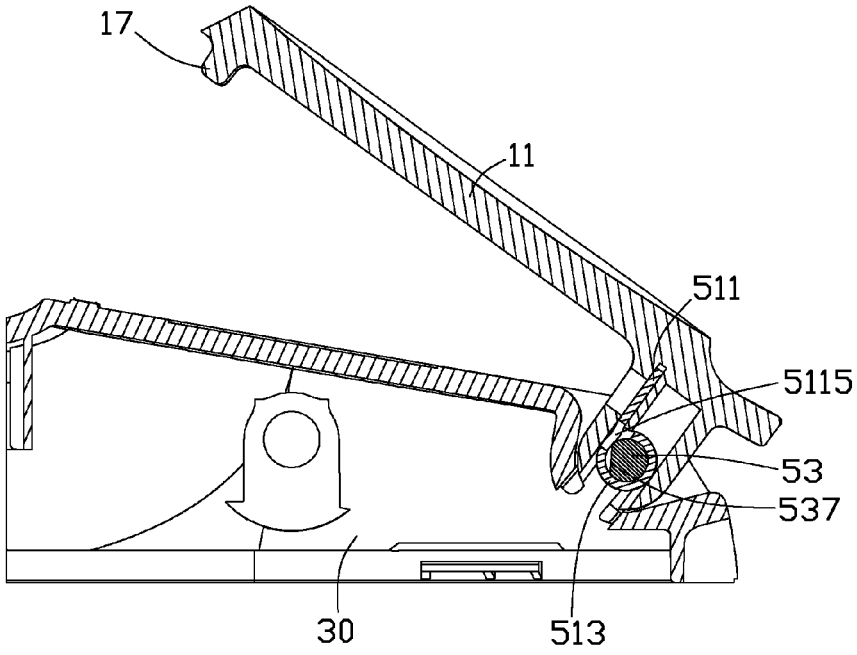
FIG. 5 is similar to the FIG. 4, but shows another working state.

FIGS. 4 and 5 show that in use, when the first main body 10 closes relative to the second main body 30 (see FIG. 4), the elastic strips 5115 resist on the planar surface 533. An end of the first main body 10 adjacent to the engaging member 17 is rotated away from the second main body 30, the first main body 10 pushes the sleeve member 51 to rotate around the fixing shaft 53. During the rotation, the elastic strips 5115 abut against the planar surface 533, and are deformed by being pressed by the planar surface 533. The elastic strips 5115 applies a torsion force to the fixing shaft 53. When a peak point of the each elastic strip 5115 reaches to the ridge 537, the deformation of the elastic strips 5115 and the torsion force exerted to the fixing shaft 53 reach their respective maximum values. And then, the elastic strips 5115 slidably cross over the ridge 537, and reaches the arcuate surface 535. The elastic strips 5115 slides on the arcuate surface 535, and the first main body 10 opens relative to the second main body 30 (see FIG. 4). When the first main body 10 is rotated towards the second main body 30, the elastic strips 5115 slide on the outer sidewall of the fixing shaft 53. The elastic strips 5115 recover until crossing over the ridge 537. When the engaging member 17 resists on the second main body 30, the first main body 10 closes relative to the second main body 30.

In other embodiments, two ridges 537 may be positioned at the fixing shaft 53 corresponding to the elastic strip 5115, and the planar surface 533 and the arcuate surface 535 can be omitted.

It is believed that the present embodiments and their advantages will be understood from the foregoing description, and it will be apparent that various changes may be made thereto without departing from the spirit and scope of the embodiments or sacrificing all of its material advantages.

What is claimed is:

1. A folding mechanism, comprising:

a first main body;

a second main body;

a hinge assembly fixed between the first main body and the second main body, the hinge assembly comprising a sleeve member and a fixing shaft, the sleeve member comprising a fixing portion and a sleeve portion, the fixing portion mounted on the first main body, the sleeve portion extending from an end of the fixing portion adjacent to the second main body, the fixing shaft inserted into the sleeve portion, and mounted to the second main body, at least one elastic strip protruding from the fixing portion towards the sleeve portion, at least one ridge protruding from the fixing shaft corresponding to the at least one elastic strip, the at least one elastic strip abutting against the fixing shaft, wherein the first main body comprises a base body and a mounting member extending from the base body towards the second main body, the mounting member defines a receiving groove, two ends of the mounting member each defines a containing groove communicating with the receiving groove, the sleeve member is received in the receiving groove, and the fixing shaft is received in the containing groove, when the first main body is rotated relative to the second main body, the at least one elastic strip moves from one side of the ridge to another side of the ridge by slidably crossing over the ridge.

2. The folding mechanism of claim 1, wherein the fixing portion defines at least one opening corresponding to the at least one elastic strip, the at least one elastic strip extends from an inner surface of the opening towards the sleeve portion.

3. The folding mechanism of claim 2, wherein the at least one elastic strip is substantially arc-shaped.

4. The folding mechanism of claim 1, wherein an outer sidewall of the fixing shaft comprises a planar surface extending along an axis of the fixing shaft and an arcuate surface extending along the axis of the fixing shaft, the arcuate surface is connected to the planar surface, the ridge is a connecting edge portion between the planar surface and the arcuate surface.

5. The folding mechanism of claim 4, wherein the at least one elastic strip resists on the planar surface when in a closed state; and the at least one elastic strip slidably crosses over the ridge to reach to the arcuate surface, and elastically resist the arcuate surface when in an open state.

6. The folding mechanism of claim 1, wherein the first main body further comprises a resisting member integrated with the mounting member, and received in the receiving groove, the resisting member comprises a blocking plate, a first resisting portion, and a second resisting portion, the blocking plate is positioned along the longitudinal direction of the receiving groove, and separates the receiving groove into a first receiving groove and a second receiving groove, the first resisting portion and the second resisting portion interconnect the blocking plate and an inner sidewall of the second receiving groove, and are received in the second receiving groove, the fixing portion of the sleeve member is received in the first receiving groove, and positioned with an inner sidewall of the first receiving groove, the sleeve portion is received in the second receiving groove, and resists on the first resisting portion and the second resisting portion.

7. The folding mechanism of claim 6, wherein the first resisting portion comprises a first contacting surface, the second resisting portion comprises a second contacting surface, the first contacting surface and the second contacting surface are substantially arcuate, the sleeve member resists the first contacting surface and the second contacting surface.

8. The folding mechanism of claim 1, wherein the second main body defines a mounting groove, the mounting member is received in the mounting groove, each of two opposite ends of the second main body defines a fixing groove communicating with the mounting groove, the fixing shaft is fixed within the fixing grooves.

9. A folding mechanism, comprising:

a first main body;

a second main body;

a hinge assembly fixed between the first main body and the second main body, the hinge assembly comprising a sleeve member and a fixing shaft, the sleeve member comprising a fixing portion and a sleeve portion, the fixing portion mounted on the first main body, the sleeve portion extending from an end of the fixing portion adjacent to the second main body, the fixing shaft inserted into the sleeve portion, and mounted to the second main body, at least one elastic strip protruding from the fixing portion towards the sleeve portion, an outer sidewall of the fixing shaft comprising a planar surface and an arcuate surface connecting with the planar surface, the at least one elastic strip abutting against the outer sidewall of the fixing shaft, wherein the first main body comprises a base body and a mounting member extending from the base body towards the second main body, the mounting member defines a receiving groove, two ends of the mounting member each defines a containing groove communicating with the receiving groove, the sleeve member is received in the receiving groove, and the fixing shaft is received in the containing groove, when the first main body is opening relative to the second main body, the at least one elastic strip moves from the planar surface to the arcuate surface via crossing over a connecting edge portion between the planar surface and the arcuate surface, when the first main body is closing relative to the second main body, the at least one elastic strip moves from the arcuate surface to the planar surface via crossing over the connecting edge portion between the planar surface and the arcuate surface.

10. The folding mechanism of claim 9, wherein the fixing portion defines at least one opening corresponding to the at least one elastic strip, the at least one elastic strip extends from an inner surface of the opening towards the sleeve portion.

11. The folding mechanism of claim 10, wherein the at least one elastic strip is substantially arc-shaped.

12. The folding mechanism of claim 9, wherein the connecting edge portion between the planar surface with the arcuate surface is a ridge.

13. The folding mechanism of claim 12, wherein the at least one elastic strip resists on the planar surface in a close state; and the at least one elastic strip crosses over the ridge to reach to the arcuate surface, and elastically resist the arcuate surface in an open state.

* * * * *